US005490439A

United States Patent [19]

Matsumura et al.

[11] Patent Number: 5,490,439

[45] Date of Patent: Feb. 13, 1996

[54] NUT TIGHTENING DEVICE

[75] Inventors: Shozo Matsumura, Toyonaka; Sueharu Yasutomi, Osaka, both of Japan

[73] Assignee: Maeda Metal Industries, Ltd., Japan

[21] Appl. No.: 336,822

[22] Filed: Nov. 8, 1994

[30] Foreign Application Priority Data

Nov. 11, 1993 [JP] Japan ..... 5-060751

[51] Int. Cl.[6] ..... B25B 21/00; B25B 23/151

[52] U.S. Cl. ..... 81/469; 81/474; 81/56; 81/57.13; 81/57.14

[58] Field of Search ..... 81/467–477, 54–57, 81/57.11, 57.13, 57.14, 57.29, 57.3, 57.31

[56] References Cited

U.S. PATENT DOCUMENTS

| | | | |
|---|---|---|---|
| 4,179,955 | 12/1979 | Akiyoshi et al. | 81/57.11 |
| 4,458,565 | 7/1984 | Zilly et al. | 81/469 |
| 4,472,985 | 9/1984 | Orikasa | 81/56 |
| 4,565,112 | 1/1986 | Fujita et al. | 81/56 |
| 4,631,992 | 12/1986 | Eckman | 81/469 X |
| 4,844,177 | 7/1989 | Robinson et al. | 81/473 X |
| 5,161,437 | 11/1992 | Yasutonri et al. | 81/56 X |
| 5,238,461 | 8/1993 | Gotman | 81/56 X |

*Primary Examiner*—D. S. Meislin

*Attorney, Agent, or Firm*—Pravel, Hewitt, Kimball & Krieger

[57] ABSTRACT

A device comprises a housing having a planetary gear reduction mechanism accommodated therein and a handle projecting therefrom, an electric motor or like rotation source attached to the housing for inputting power to the reduction mechanism, an outer socket coupled to an internal gear of the reduction mechanism and engageable with a nut, an inner socket coupled to a planetary gear support frame of the reduction mechanism and engageable with a bolt tip, and a torque detecting control mechanism for detecting a nut tightening force to discontinue supply of power to the rotation source upon the tightening force reaching a predetermined value. A friction ring is provided between the housing and the support frame coupled to the inner socket to effect frictional engagement therebetween. A definite axial tension is available by rotating the outer socket, i.e., the nut, with the inner socket in a fixed state. Even if the bolt should rotate about its axis, the support frame slips, whereby the tightening device is prevented from turning around in its entirety.

7 Claims, 4 Drawing Sheets

NUT TIGHTENING DEVICE

FIELD OF THE INVENTION

The present invention relates to tightening devices for use in bolt-and-nut fastening, and more particularly to a tightening device for pretightening chiefly shear bolts having a tip to be sheared, by tightening a nut as screwed on the bolt.

BACKGROUND OF THE INVENTION

In tightening up a shear bolt having a tip which is sheared when subjected to a definite tightening torque, the bolt is pretightened, before being tightened up, with a torque predetermined in accordance with a required torque. A stabilized relation between the pretightening torque and the axial tension is necessary at all times to assure the bolt of a stabilized axial tension.

The shear bolt is in a free state when merely inserted into a bolt hole since the bolt hole is sized with an allowance of about 2 mm relative to the bolt diameter.

Accordingly, it is basic practice to tighten the nut into intimate contact with the member to be fastened before the shear bolt is pretightened, whereas it is likely that this procedure will not be followed or will be insufficient.

The bolt will turn about its own axis if pretightened when the nut is not in intimate contact with the member to be fastened, namely when the nut is free or nearly free.

Further when oil or water ingress in between the bolt head and the member to be fastened, the frictional force between the contact faces of the bolt and the member becomes smaller than the frictional force between the nut and the washer, consequently permitting the rotation of the bolt about its axis during tightening.

To ensure a stabilized relation between the tightening torque and the axial tension, it is important to effect tightening by rotating the nut only without permitting rotation of the bolt and washer relative to the member to be fastened. However, the rotation of the bolt about its axis, if occurring as stated above, disturbs the relation between the tightening torque and the axial tension, so that the required axial tension becomes no longer available.

During tightening, the reaction of tightening produces a force acting to turn the tightening device around, placing a great burden on the worker who is holding the device and also entailing a hazard. This becomes more pronounced if the device is adapted for high-speed rotation.

An object of the present invention is to provide a nut tightening device which gives a proper axial tension when tightening a nut as screwed on a bolt and which is minimized in the force resulting from the reaction and acting to cause the device itself to turn around.

SUMMARY OF THE INVENTION

The present invention relates to a nut tightening device for use in tightening a nut as screwed on a shear bolt having a tip to be sheared. The device comprises a planetary gear reduction mechanism accommodated within a housing, an outer socket engageable with the nut and coupled to an internal gear of the reduction mechanism, an inner socket engageable with the bolt tip and coupled to a planetary gear support frame of the reduction mechanism, a friction ring provided between the support frame and the housing for holding the support frame slippably in frictional engagement with the housing, and a rotation source attached to the housing for inputting power to the reduction mechanism within the housing through a torque detecting control mechanism, the torque detecting control mechanism being operable to detect a nut tightening force and discontinue supply of the power from the rotation source upon the tightening force reaching a predetermined value.

DESCRIPTION OF THE PREFERRED EMBODIMENT

Figure 1:
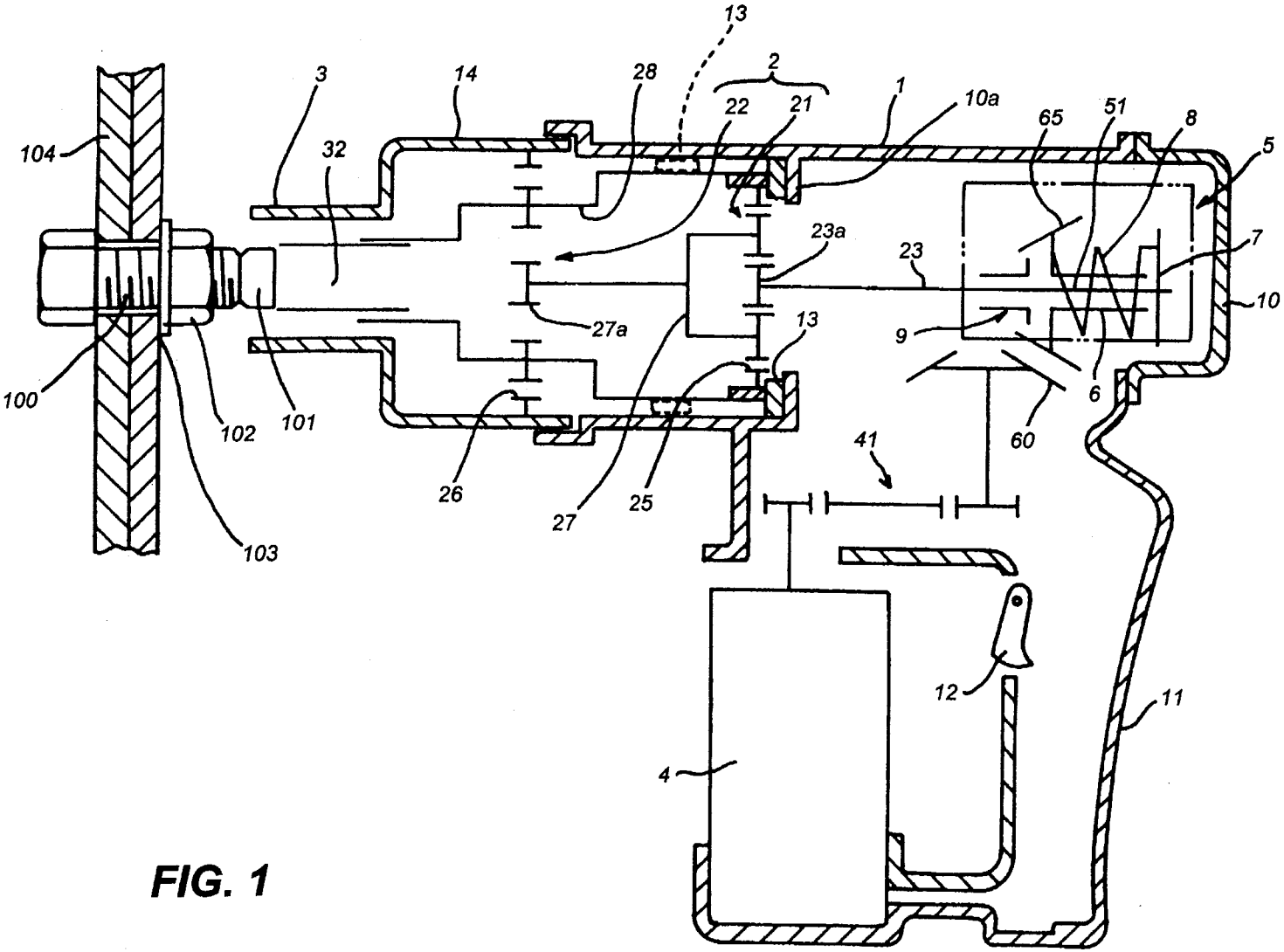
FIG. 1 is a diagram schematically showing a nut tightening device of the invention.
Figure 2:
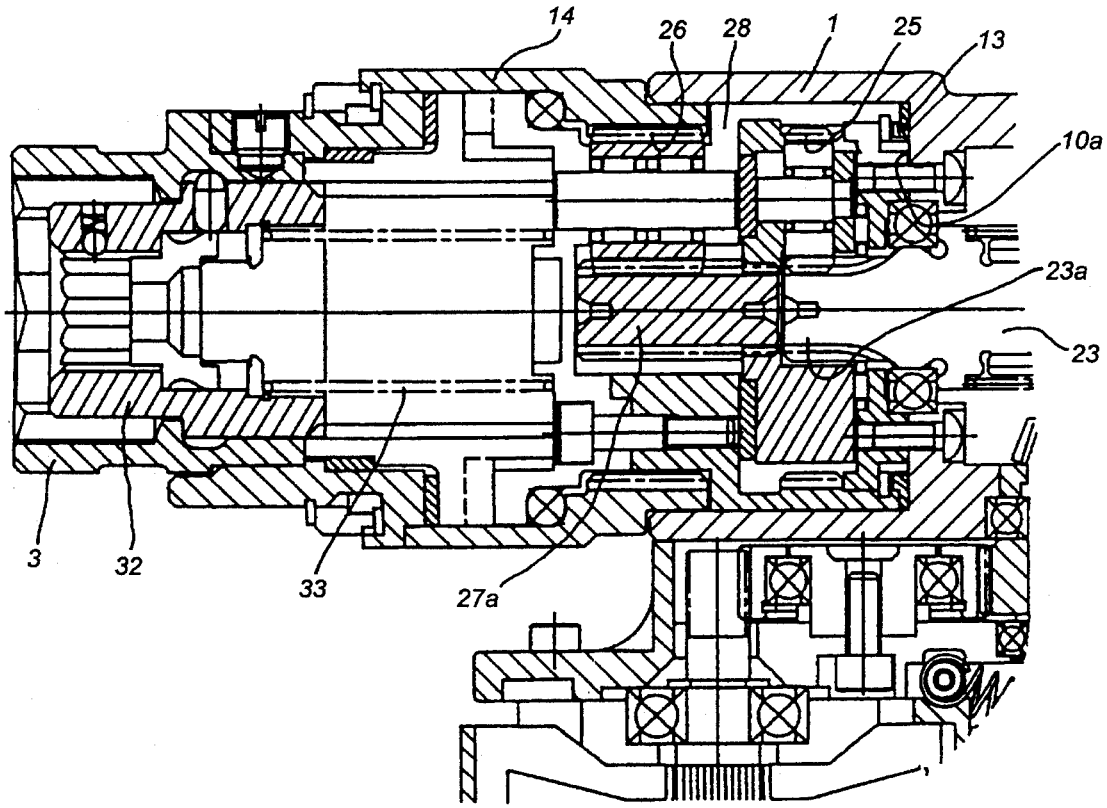
FIG. 2 is a detailed view in section showing the socket side of the tightening device.
Figure 3:
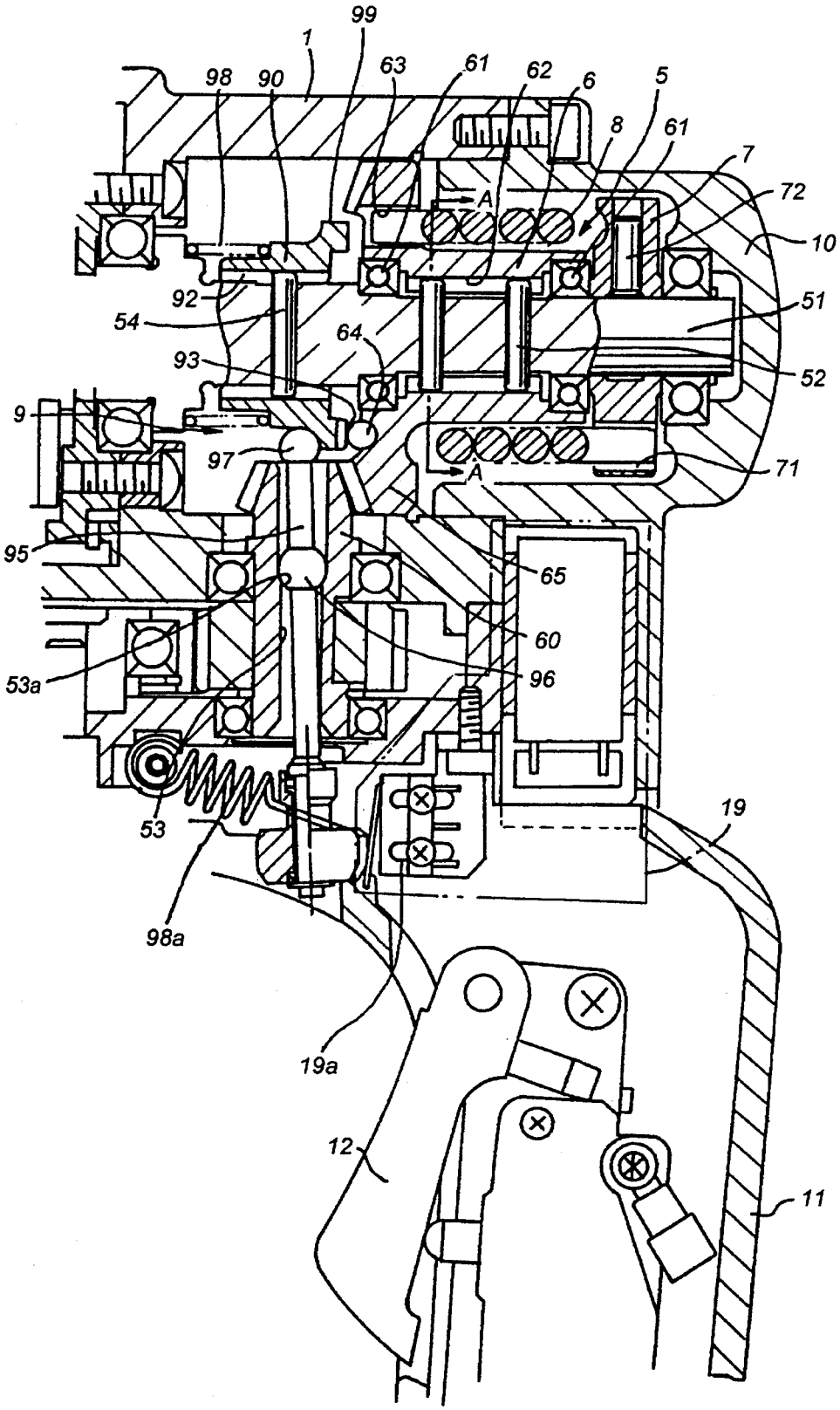
FIG. 3 is a sectional view of the handle side of the tightening device.
Figure 4:
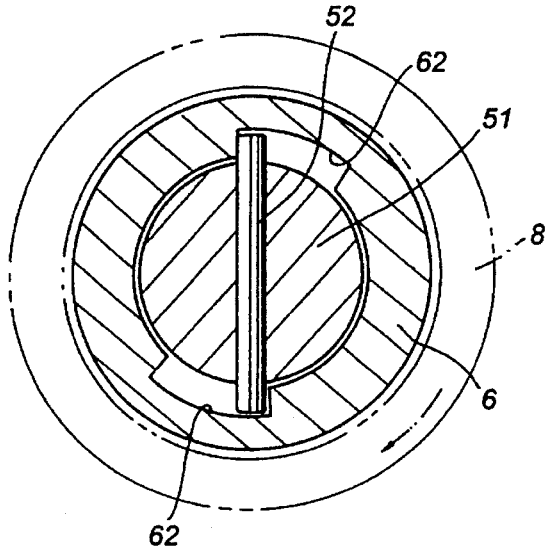
FIG. 4 is a view in section taken along the line A—A in FIG. 3.
Figure 5:
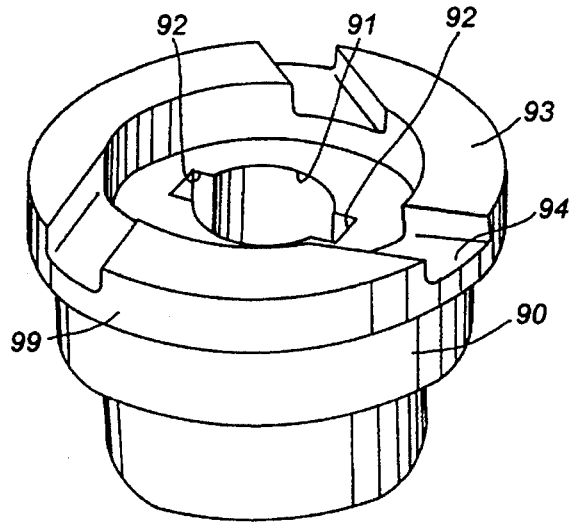
FIG. 5 is a perspective view of a sleeve.
Figure 6:
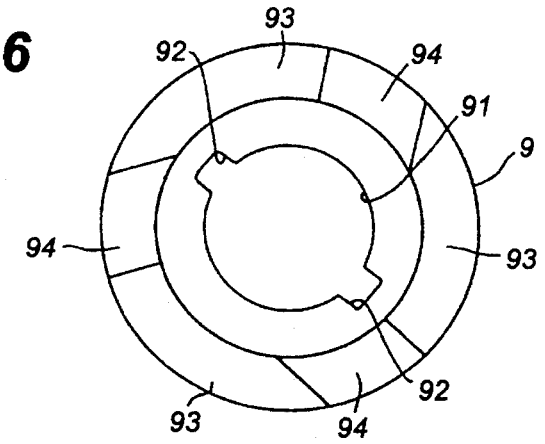
FIG. 6 is a plan view of the sleeve.

FIG. 1 schematically shows a nut tightening device having a nut engaging outer socket 3 and a bolt tip engaging inner socket 32 concentrically therewith for pretightening shear bolts. FIG. 2 is a detailed sectional view of the socket side of the device, and FIG. 3 is a detailed sectional view of the handle side thereof.

A tubular housing 1 has a base end provided with a handle 11. Disposed approximately in parallel to the handle 11 is an electric motor 4 serving as a drive source for effecting rotation. The drive source may alternatively be an air motor or other power source.

The housing 1 has a forward end provided with a rotatable auxiliary cylinder 14. A gear reduction mechanism 2 is accommodated in the housing 1 and also in the cylinder 14.

The housing 1 has an open rear portion with a closure 10 attached thereto, such that the torque detecting control mechanism 5 to be described later can be adjusted to a predetermined torque outside the housing 1 and then placed into the housing 1 through the rear portion.

The motor 4 is coupled to the reduction mechanism 2 by means of a spur gear train 41, bevel gears 60, 65 and torque detecting control mechanism 5.

According to the preferred embodiment, the reduction mechanism 2 has a two-stage construction comprising a first planetary gear reduction unit 21 and a second planetary gear reduction unit 22 coupled to the unit 21. The reduction mechanism is not limited to the two-stage type but can of course be of the single-stage, three-stage or multistage type.

The torque detecting control mechanism 5 has an output shaft 23 projecting therefrom and carrying a sun gear **23*a* of the first reduction unit 21. The unit 21 has a first planetary gear support frame 27 provided with a sun gear 27*a* of the second reduction unit 22**.

The first reduction unit 21 has an internal gear 25 which is formed on a second planetary gear support frame 28 of the second reduction unit 22. The second reduction unit 22 has an internal gear 26 formed on the inner surface of the auxiliary cylinder 14.

The outer socket 3 and the inner socket 32 are connected respectively to two output shafts of the gear reduction mechanism 2. More specifically, the outer socket 3 is provided at the forward end of the auxiliary cylinder 14 and coupled to the internal gear 26 of the second reduction unit 22. The inner socket 32 is slidably provided on the support frame 28 of the second reduction unit 22 and biased by a spring 33 toward a jumping-out direction.

When a planetary gear reduction mechanism of at least three stages is used, the inner socket is provided on the planetary gear support frame of the last stage, and the internal gear of the planetary gear unit is formed on the inner surface of the auxiliary cylinder having the outer socket.

A friction ring 13 is provided between a flange 10*a* formed on the housing 1 and a tubular end of the support frame 28 of the second reduction unit 23 which end is positioned toward the control mechanism 5, whereby the support frame 28 is held in frictional engagement with the housing 1. Accordingly, the inner socket 32 coupled to the support frame 28 is also in frictional engagement with the housing 1.

The friction ring 13 need not always be provided at the position between the end of the support frame 28 and the flange 10*a* of the housing 1 but may alternatively be provided between the inner surface of the housing 1 and the outer periphery of the support frame 28 as indicated in a broken line in FIG. 1.

The input shaft 23 for the first planetary gear reduction unit 21 extends into a rotary shaft 51 carrying the torque detecting control mechanism 5 thereon.

The control mechanism 5 may be of any construction insofar as the mechanism discontinues the transmission of rotation to the input shaft 23 when the shaft is subjected to a load exceeding a predetermined torque.

According to the preferred embodiment, the control mechanism 5 comprises a cylindrical rotatable member 6 fitting around the rotary shaft 51 rotatably independently of the rotation of the shaft and having the bevel gear 65 at one end thereof, a torque setting disk 7 opposed to the rotatable member 6 and fixed to the rotary shaft 51, a torsion spring 8 coupling the rotatable member 6 to the torque setting disk 7, and phase sensor means 9 for detecting a difference in phase between the rotary shaft 51 and the rotatable member 6 when the torsion spring 8 is deformed by a great load acting on the rotary shaft 51 to result in the phase difference.

The rotatable member 6 is supported by bearings 61, 61 on the rotary shaft 51 and has an inner periphery defining a shaft bore and formed with grooves 62, 62 which are opposed to each other diametrically of the shaft 51 and extending axially thereof. Needle members 52, 52 extend through the rotary shaft 51 orthogonally to the shaft axis and each have opposite ends loosely fitted in the respective grooves 62, 62.

The torque setting disk 7 is fastened to the shaft 51 with a clamp screw 72 radially extending through the disk in screw-thread engagement therewith, and is rotatable witch the shaft.

The torsion spring 8 is loosely fitted around the rotatable member 6 and has its opposite ends bent outward and fitted in engaging holes 63, 71 which are formed in the rotatable member 6 and the disk 7, respectively.

The rotation of the motor 4 is transmitted to the rotatable member 6 via the spur gear train 41 and bevel gears 60, 65 and further to the rotary shaft 51 via the torsion spring 8 and torque setting disk 7 to drivingly rotate the outer socket 3 by way of the reduction mechanism 2.

The torque setting disk 7 is turned in a direction to contract the torsion spring 8 in advance and fastened, as deformed in corresponding relation to the required torque to be transmitted, to the rotary shaft 51 with the screw 72. Because of this torque adjustment, the needle members 52 on the rotary shaft 51 are prevented from coming into contact with the wall of the rotatable member 6 defining the groove 62 to rotate the member 6 with the disk 7 when the disk 7 is rotated to twist the torsion spring 8.

Upon a load in excess of the predetermined value acting on the outer socket 3, the rotatable member 6 idly rotates around the shaft 51 and becomes different in phase relative to the shaft 51.

The difference between the rotatable member 6 and the rotary shaft 51 in phase is detected by phase sensor means 9, which comprises a sleeve 90 mounted on the rotary shaft 51 rotatably therewith and slidable axially thereof, a lever 95 movable by the axial movement of the sleeve and a switch circuit 19 operable to deenergize the motor 4 by the movement of the lever.

The sleeve 90 has an inner surface defining a bore 91 and formed with grooves 92, 92 opposed to each other diametrically of the shaft 51. A needle member 54 extending through the rotary shaft 51 orthogonally to the shaft axis has its opposite ends fitted in the respective grooves 92, 92 without any clearance left with respect to the direction of rotation. The sleeve 90 is biased toward the rotatable member 6 by a spring 98.

The sleeve 90 has a flange 99 at one end thereof toward the rotatable member 6. The flange 99 has an end face formed with alternating ridges 93 and furrows 94.

The rotatable member 6 has an end face adjacent to the sleeve 90 and provided with a spherical projection 64 in bearing contact with the ridge 93 of the sleeve 90. The projection 64 is provided by a ball implanted in the end face of the member 6 and partly exposed therefrom.

The drive bevel gear 60 meshing with the bevel gear 65 of the rotatable member 6 is formed with a through bore 53 in alignment with its axis. The lever 95 is pivotably disposed in the bore 53.

The lever 95 extends at its opposite ends from the bevel gear 60 and is provided with spherical protuberances 96, 97 at the middle and upper end thereof, respectively. The middle protuberance 96 is movably fitted in the bore 53 of the bevel gear 60 and prevented from slipping off downward by a stepped portion 53*a* in the bore.

The upper-end protuberance 97 of the lever 95 bears on the rear side of the flange 99 of the sleeve 90.

A spring 98*a* is attached to the lower end of the lever 95 for biasing the sleeve 90 into pressing contact with the rotatable member 6. The lever lower end is connected to a microswitch 19*a* of the switch circuit 19, holding the switch 19*a* on when the tightening device is to be started.

The sleeve 90 is biased toward the rotatable member 6 by the two springs, i.e., by the spring 98 directly biasing the sleeve and the spring 98*a* attached to the lever 95, whereas the biasing force on the member 6 is weaker than the restoring force of the torsion spring 8.

The switch circuit 19 is so designed that when the microswitch 19*a* is turned off while a trigger 12 is on, namely, while the motor 4 is energized, the energizing circuit is broken to stop the motor 4 although the trigger 12 is on, and that when the trigger 12 is turned on after it has been turned off, the motor 4 is started.

The outer socket 3 is engaged with the nut 102 to be tightened, and the inner socket 32 with a bolt tip 101.

The trigger 12 is turned on to start the motor 4. The torque of the motor 4 is transmitted to the rotatable member 6 via the spur gear train 41, bevel gear 60 and bevel gear 65. The rotation of the rotatable member 6 is transmitted to the torque setting disk 7 through the torsion spring 8. The reduction mechanism 2 operates since the disk 7 is fastened to the rotary shaft 51 with the clamp screw 72, with the shaft 51 made integral with the input shaft 23 for the first planetary gear reduction unit 21.

Of the two output shafts of the planetary gear reduction unit 22 of the last stage, the one coupled to the inner socket 32, i.e., the second planetary gear support frame 28, is held in frictional engagement with the housing 1 by the friction ring 13 and is therefore prevented from rotation, while only the internal gear 26 serving as the other output shaft coupled to the outer socket 3 rotates to tighten the nut 102.

When the nut 102 has been tightened to the predetermined torque, the torsion spring 8 is subjected to a load greater than the twisting torque to which the spring is set and is thereby deformed to produce a difference in phase angle between the spring 8 and the disk 7, namely, between the spring 8 and the rotary shaft 51.

A difference in phase angle occurs also between the rotatable member 6 and the sleeve 90 rotating with the shaft 51 to position the furrow 94 of the sleeve 90 as opposed to the projection 64 on the rotatable member 6, whereupon the sleeve 90 slidingly moves toward the member 6 by a distance corresponding to the depth of the furrow 94 by being biased by the spring 98.

The lever 95 accommodated in the through bore 53 of the bevel gear 60 and biased toward the rotatable member 6 with its upper end bearing on the sleeve 90 pivotally moves following the movement of the sleeve 90, turning off the microswitch 19*a* with the lever lower end to break the energizing circuit of the motor 4, whereby pretightening of the nut on the bolt is completed with the predetermined torque.

When the motor 4 stops, the rotatable member 6 is freed from the driving force, permitting the torsion spring 8 to restore itself to rotate the member 6 and return the member 6 and shaft 51 to the original phase relation. The rotation of the rotatable member 6 causes the projection 64 thereon to move out of the furrow 94 of the sleeve 90 and ride onto the ridge 93 thereof while pushing the sleeve 90 axially, whereby the member 6 and the sleeve 90 are returned to the original state.

After the motor 4 has been deenergized, the trigger 12 is turned off in preparation for the next pretightening operation.

With the tightening device of the above embodiment, the torque setting disk 7 is rotated on the rotary shaft 51 in advance to deform the torsion spring 8 with a desired torque so that the spring 8 starts to deform at the required tightening torque value during use. The tightening torque can be controlled as desired by adjusting the amount of deformation of the torsion spring before use.

The nut can be pretightened efficiently with the predetermined torque by the procedure described. The tightening torque is controllable even when the target tightening torque is low or when the output rotation speed is high to result in a very short tightening time.

Further a voltage drop which is likely to occur, for example, at a site of construction will not influence the accuracy of tightening torque control.

On completion of pretightening, the bolt-and-nut assembly is tightened up by a complete tightening device until the bolt tip 101 is sheared.

With the nut tightening device of the invention described above, the inner socket 32 is held in frictional engagement with the housing 1, permitting rotation of the outer socket 3 only. This prevents the bolt from rotating about its axis even in the case where the nut is pretightened while it is not in intimate contact with the member to be fastened, i.e., while the nut is free or nearly free, or when the frictional force between the contact faces of the bolt and the member is smaller than the frictional force between the nut and the washer owing to the presence of oil or water between the bolt head and the member, consequently obviating the problem that the required axial tension is not available owing to the rotation of the bolt about its axis.

Further if the bolt should rotate about its axis, for example, owing to extraneous matter biting in between the nut and washer as in the case where the output shaft for driving the inner socket 32, i.e., the second planetary gear support frame 28, is not slippable but secured to the housing 1, the friction ring 12 slips permitting rotation of the support frame 28 relative to the housing 1. This eliminates the likelihood that a rotational force about the bolt axis in excess of the frictional force between the output shaft and the housing 1 will act on the worker holding the tightening device to ensure the safety of tightening operation.

The nut tightening device of the present invention is useful especially for tightening one-side bolts.

As is known, the one-side bolt is inserted through a bolt hole in the member to be fastened, from the tightening side thereof, and a nut screwed on the bolt from the tightening side is tightened to thereby plastically deform the opposite end of a tubular portion covering the bolt into a bulged flange and to fasten the member as held between the flange and the nut.

One-side bolts include those having at its base end a tip to be sheared, and those having a tip not intended for shearing but for preventing rotation during tightening. The bolt of either of these types is idly rotatable when merely inserted through the bolt hole.

When the present device is used for tightening the nut as engaged in the outer socket with the bolt tip engaged in the inner socket, the nut can be pretightened or completely tightened up efficiently with the bolt prevented from rotation about its axis to ensure the specified axial tension.

The present invention is not limited to the construction of the above embodiment but can be modified variously within the scope as defined in the appended claims.

What is claimed is:

1. A nut tightening device for use in tightening a nut as screwed on a shear bolt having a tip to be sheared, the device comprising a planetary gear reduction mechanism accommodated within a housing, an outer socket engageable with the nut and coupled to an internal gear of the reduction mechanism, an inner socket engageable with the bolt tip and coupled to a planetary gear support frame of the reduction mechanism, a friction ring provided between the support frame and the housing for holding the support frame slippably in frictional engagement with the housing, and a rotation source attached to the housing for inputting power to the reduction mechanism within the housing through a torque detecting control mechanism, the torque detecting control mechanism being operable to detect a nut tightening force and discontinue supply of the power from the rotation source upon the tightening force reaching a predetermined value.

2. A nut tightening device as defined in claim 1 wherein the planetary gear support frame of the reduction mechanism has a tubular end toward the torque detecting control mechanism, and the friction ring is provided between the tubular end and a flange formed on the housing.

3. A nut tightening device as defined in claim 1 wherein the friction ring is provided between the inner surface of the housing and an outer peripheral surface of the support frame.

4. A nut tightening device as defined in claim 1 wherein the torque detecting control mechanism comprises a cylindrical rotatable member fitting around a rotary shaft independently of the rotation of the shaft and having a bevel gear at one end thereof, a torque setting disk opposed to the rotatable member and fixed to the rotary shaft, a torsion spring coupling the rotatable member to the torque setting disk, and phase sensor means for detecting a difference in phase between the rotary shaft and the rotatable member when the torsion spring is deformed by a great load acting on the rotary shaft to result in the phase difference.

5. A nut tightening device as defined in claim 4 wherein the rotatable member is supported by bearings on the rotary shaft and has an inner periphery defining a shaft bore and formed with grooves, the grooves being opposed to each other diametrically of the shaft and extending axially thereof, needle members extending through the rotary shaft orthogonally to the axis of the shaft and each having opposite ends loosely fitting in the respective grooves of the rotatable member.

6. A nut tightening device as defined in claim 4 wherein the torsion spring is loosely fitted around the rotatable member and has opposite ends bent outward and fitting in engaging holes formed in the rotatable member and the torque setting disk respectively.

7. A nut tightening device as defined in claim 4 wherein the phase sensor means comprises a sleeve mounted on the rotary shaft rotatably therewith and slidable axially thereof, a lever movable by the axial movement of the sleeve and a switch circuit operable by the movement of the lever to deenergize the rotation source.

* * * * *